US010829363B2

(12) United States Patent
Coffin et al.

(10) Patent No.: US 10,829,363 B2
(45) Date of Patent: Nov. 10, 2020

(54) CONTROLLED FLEX THROUGH THE USE OF STOPPLES

(71) Applicants: Edmund Coffin, Ruckersville, VA (US); Stanley P Yavoroski, New Hope, PA (US)

(72) Inventors: Edmund Coffin, Ruckersville, VA (US); Stanley P Yavoroski, New Hope, PA (US)

( * ) Notice: Subject to any disclaimer, the term of this patent is extended or adjusted under 35 U.S.C. 154(b) by 162 days.

(21) Appl. No.: 15/482,433

(22) Filed: Apr. 7, 2017

(65) Prior Publication Data

US 2017/0291809 A1 Oct. 12, 2017

Related U.S. Application Data

(60) Provisional application No. 62/319,462, filed on Apr. 7, 2016.

(51) Int. Cl.
*B68C 1/02* (2006.01)

(52) U.S. Cl.
CPC ..... *B68C 1/025* (2013.01); *B68C 1/02* (2013.01)

(58) Field of Classification Search
CPC .. B68C 1/02; B68C 1/025; B68C 1/04; B68C 2001/042; B68C 1/08; B62J 1/002; B62J 1/005; B62J 1/007; B62J 1/10
USPC ..... 54/44.1, 44.7, 44.3, 44.6; 297/195.11, 297/202, 195.1
See application file for complete search history.

(56) References Cited

U.S. PATENT DOCUMENTS

| | | | | |
|---|---|---|---|---|
| 3,258,894 | A | 7/1966 | Hoaglin | |
| 3,293,828 | A | 12/1966 | Hessier | |
| 3,712,024 | A | 1/1973 | Nankivell | |
| 3,780,494 | A | 12/1973 | Nankivell | |
| 3,997,214 | A | 12/1976 | Jacobs | |
| 5,101,614 | A | 4/1992 | Bozanich | |
| 5,203,607 | A * | 4/1993 | Landi | B62J 1/26 297/214 |
| 5,343,674 | A * | 9/1994 | Brown | B68C 1/04 54/44.1 |
| 5,823,618 | A | 10/1998 | Fox | |
| 6,044,630 | A | 5/2000 | Coffin | |
| 6,254,180 | B1 | 7/2001 | Nelson | |
| 6,691,498 | B2 | 2/2004 | Coffin | |
| 6,976,736 | B2 * | 12/2005 | Yu | B62J 1/00 297/215.16 |
| 7,231,889 | B2 | 6/2007 | Coffin | |
| 7,661,756 | B2 | 2/2010 | chen | |

(Continued)

*Primary Examiner* — Lisa T Tsang
(74) *Attorney, Agent, or Firm* — Kimberly O Snead

(57) ABSTRACT

Multiple flex units are used to provide predetermined focused areas of flex in a substrate, such as an equine saddle tree, Apertures are placed on the underside and filled with either a combination of stopple and slurry or slurry alone, each forming a flex unit. The placement, dimensions and fill of the flex unit enable a predetermined focused area of flex to be established within the specific area. The slurry is a mixture of carbon fibers and epoxy and the stopples are a mixture of substrate and epoxy to form hard stopples, a mixture of composite and flexible epoxy to form more flexible stopples; or a combination hard and flexible mixture in a stopples. The shape, periphery, diameter and depth each of the apertures and hardness, size and category of the stopples as well as location of placement determines the area, degree and direction of the flex.

17 Claims, 7 Drawing Sheets

(56) References Cited

U.S. PATENT DOCUMENTS

| | | | | |
|---|---|---|---|---|
| 7,757,311 | B2 * | 7/2010 | Garneau | A41D 1/084 2/215 |
| 8,249,800 | B2 | 8/2012 | Hoshizaki | |
| 9,132,874 | B2 * | 9/2015 | Sam | B62J 1/22 |
| 2006/0059869 | A1 * | 3/2006 | Brown | B68C 1/12 54/44.3 |
| 2007/0273184 | A1 * | 11/2007 | Garneau | B62J 1/00 297/195.1 |
| 2013/0214568 | A1 | 8/2013 | Mueller | |
| 2014/0311105 | A1 * | 10/2014 | Coffin | B29C 65/72 54/44.7 |
| 2016/0159637 | A1 * | 6/2016 | Kahlbetzer | B68C 1/025 54/44.7 |
| 2016/0316828 | A1 * | 11/2016 | Wyner | A63B 71/08 |
| 2017/0355410 | A1 * | 12/2017 | Yim | B62J 1/08 |

* cited by examiner

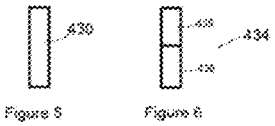
Figure 12
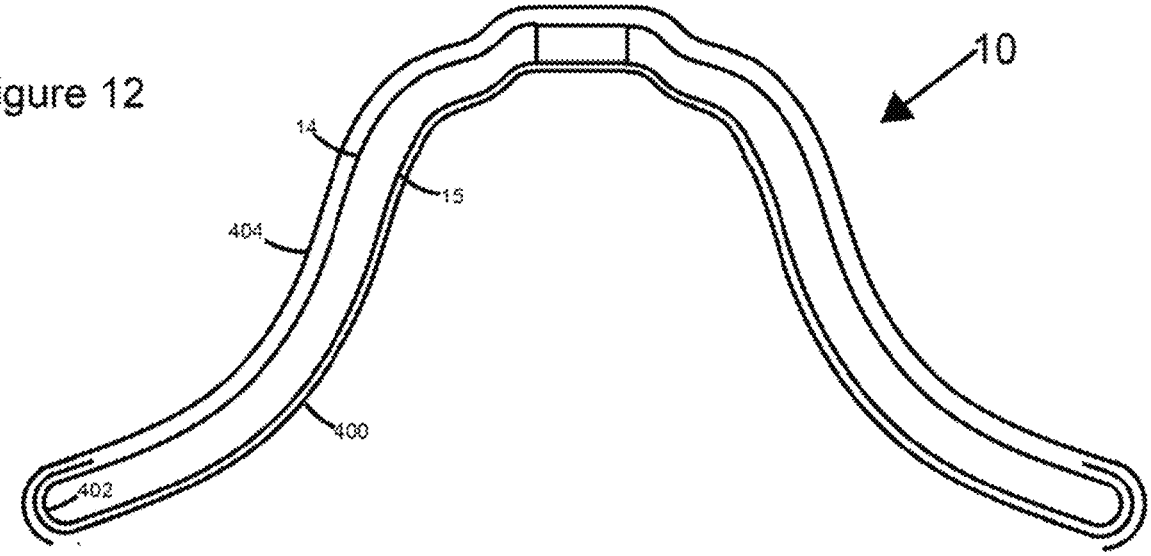

CONTROLLED FLEX THROUGH THE USE OF STOPPLES

FIELD OF THE INVENTION

This invention relates to the control of flexibility of material through the use of apertures and stopples as flex modulators.

BRIEF DESCRIPTION OF THE PRIOR ART

Thermoplastic substrates provide advantages over wood and metals in many applications where weight, high strength, and shapeability are critical. There is no way, however, to create areas of flex within a rigid object without changing the thickness or creating apertures at critical areas. The thinning of the areas however creates a weakness in the material that can lead to breakage or over flexing.

Saddle trees are an example of where a combination of strength and specific areas of flexibility are required. The traditional saddle tree is comprised of thin layers of wood with glue in between, that are molded into the desired form. Metal reinforcement is used along the sides of the saddle as well as the gullet. The life span of the glued wood trees with metal reinforcement is limited as eventually use stretches the width of the tree and increases the possibility of severe torquing. Prior art methods of compensating for the breakdown of the traditional tree have been to add metal reinforcements, which subsequently add weight. Many saddles eventually fail from the affects of constant use and, at times, considerable torque. Strength, however, remained an issue. Saddles must provide some flexibility: however excessive torque and force management have been a problem with prior art trees of wood construction. A professional quality saddle is an expensive investment and expected to last many years. A cracked, weakened or broken tree, however, immediately makes the saddle unusable.

In U.S. Pat. No. 5,101,614 a hollow saddle tree formed of rotationally molded cross-linked polyethylene was disclosed. The hollow saddle tree is of unitary, one piece construction and formed of cross-linked polyethylene by a rotational molding process with all of the structural elements of the saddle being of substantially equal thickness. Because the saddle free is hollow, light and sufficiently flexible, it conforms to the contours of the hack of the horse. A saddle tree of this form may exhibit significant flexibility, however it is lacking the structural integrity to obtain optimal performance. Fiberglass reinforced plastics have also been used to reduce the cost of saddle manufacturing. Saddle trees of this nature are described in U.S. Pat. No. 3,293,828 to Hessler incorporated herein by reference. The problem with fiberglass-reinforced saddle trees is that they are too rigid resulting in hot spots and micro fractures resulting in a break down of structural integrity. In addition, saddle trees formed of fiber reinforced plastics are too stiff and do not conform to the horse's back. In consequence, they cause abrasion to the sides of the horse, to the material discomfort of the horse. Saddles formed of foam-filled fiber reinforced plastics have also been described in U.S. Pat. No. 3,258,894 to Hoaglin. In this construction, two sections are molded from fiber reinforced plastic, combined together and the interior filled with urethane foam. Injected molded saddles have also been tried and described in U.S. Pat. Nos. 3,712,024 and 3,780,494. High cost of molding, difficulty of quality control, and lack of versatility have been the problems with injected molded saddles.

SUMMARY OF THE INVENTION

A substrate, such as an equine saddle tree, provides predetermined focused areas of flex through the use of flex units. An example saddle tree, has a moldable substrate body with a top surface, an underside, a cantle, a pommel, a center channel, sidebars between the cantle and pommel and multiple flex units. Apertures are placed on the underside and filled with either a combination of stopple and slurry or slurry alone, each forming a flex unit. The placement, dimensions, and fill of the flex unit enable a predetermined focused area of flex to be established within the specific area.

The slurry is a mixture of carbon fibers and epoxy. Stopples comprised of a mixture of substrate and epoxy with a hardness similar to surrounding substrate form hard stopples. Flexible stopples are comprised of a mixture of composite and flexible epoxy, providing less resistance to flexing than hard stopples. Combination stopples, having about one half of the length a hard stopple and about one half of the length a flexible stopple, are also used when the amount of flex needs to be divide within the aperture. The hardness of the stopple directly affects the flexibility.

Each of the flex units has an aperture having a shape, a periphery, a diameter and a depth, and at least one flit material. The shape, periphery, diameter and depth each of the apertures and stopples forms the flex unit category. The category as well as location of placement determines the area, degree, and direction of the flex. The fill for each aperture can be a stopple having a diameter and length and retained by slurry or slurry alone.

The one category of flex units are an aperture having a diameter substantially greater than the diameter of the stopple. The aperture is filled with a slurry which is permitted to harden and a second aperture placed in the hardened slurry. The second aperture having a diameter slightly greater than the diameter of the stopple. The stopple is then secured within the second aperture by additional slurry.

Other category of flex units are apertures having a diameter slightly greater than the diameter of the stopple with the stopple being secured within the aperture by slurry. In some flex units, forming another category, an additional aperture can be placed within the stopple after it is secured in the primary aperture. In another category the flex unit is an aperture filled only with the slurry.

The large stopples have a diameter in the range of 0.109 in. (2.78 mm) to 0.243 in (6.18 mm) and preferably 0.203 in (5.18 mm). Smaller stopples have a diameter in the range of 0.060 in (1.54 mm) to 0.143 in (3.64 mm) and preferably 0.103 in (2.64 mm). The stopples extend about 0.005 in. (0.127 mm) to about 0.5 in (12.7 mm) above the underside of the substrate body.

The apertures are placed on the underside of the substrate and a level of fill for each of the flex units is selected from the group comprising lower than a same plane as the underside; on a same plane as the underside; or above the plane of the underside, with the level of fill affecting the flexibility. The fill comprising a slurry and stopple combination or slurry alone.

The shape of the apertures affects the direction of flex. A circular aperture enables 360 degrees of flex while a non-circular aperture enables greater flex along the minor axis, with less along the major axis.

BRIEF DESCRIPTION OF THE DRAWINGS

The advantages of the instant disclosure will become more apparent when read with the specification and the drawings, wherein:

FIG. 5 is a side view of a single layer stopple, in accordance with the disclosed invention;

FIG. 6 is a side view of a layered stopple, n accordance with the disclosed invention;

FIG. 12 is a cutaway side view of the saddle tree illustrating the wrapping of the composite covering in accordance with the disclosed invention;

DETAILED DESCRIPTION OF THE INVENTION

List of Components

Figure 1:
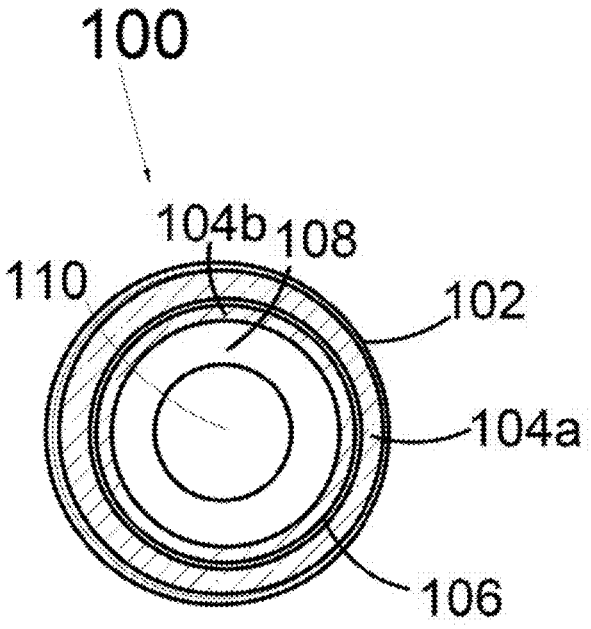
FIG. 1 is an enlarged top view of a large flex unit with an interior aperture, in accordance with the disclosed invention.

| Number | |
|---|---|
| 10 | Saddle tree |
| 12 | Edge of Saddle tree |
| 14 | Topside of Saddle tree |
| 15 | Underside of Saddle tree |
| 18 | Open Channel |
| 22 | Centerline of Saddle tree |
| 42 | Interior edge of open channel |
| 53 | Wave Depression |
| 54 | Wave Depression |
| 55 | Wave Depression |
| 56 | Wave Depression |
| 57 | Wave Depression |
| 58 | Wave Depression |
| 59 | Wave Depression |
| 60 | Wave Depression |
| 61 | Wave Depression |
| 62 | Wave Depression |
| 71 | Pommel Wave |
| 72 | Ellipse |
| 73a | Slot |
| 73b | Slot |
| 75a | Scalloped portion of 42 within channel section 702 |
| 75b | Scalloped portion of 42 within channel section 704 |
| 75c | Scalloped portion of 42 within channel section 706 |
| 80 | Pommel |

-continued

| Number | |
|---|---|
| 83c | Single aperture |
| 100 | Large Flex Unit |
| 102 | Primary aperture |
| 104a | slurry |
| 104b | slurry |
| 106 | Second aperture |
| 108 | stopple |
| 110 | Interior aperture/tertiary aperture |
| 118 | Small flex unit |
| 120 | Primary Aperture |
| 124a | slurry |
| 124b | slurry |
| 13) 126 | Secondary aperture |
| 128 | stopple |
| 130 | Multiple stopple unit/multiple flex unit |
| 132 | Oval surrounding aperture |
| 134 | Slurry |
| 136 | Apertures/secondary aperture |
| 137 | Slurry |
| 138 | Stopple |
| 139 | Single slurry flex unit |
| 280 | Proximal section of Pommel |
| 282 | Pommel Edge/Apex of pommel |
| 284 | aperture |
| 350 | Saddle Nail |
| 430 | Single composition stopple |
| 434 | Layered Composition Stopple |
| 436 | Bottom/soft Epoxy Layer |
| 438 | Top/Hard Epoxy Layer |
| 702 | Section of Open Channel |
| 704 | Section of Open Channel |
| 706 | Section of Open Channel |
| 708 | Section of Open Channel |
| 782 | cantle |
| 783a | Aperture |
| 783b | Aperure |
| 906 | Leather Flap of Saddle |

DETAILED DESCRIPTION OF THE INVENTION

Definitions

For the purposes as employed herein, the term aperture shall refer to an opening of any configuration that is placed in the body of an object.

For the purposes as employed herein, the term "composite" shall generically refer to any strengthening agent used to reinforce another material, and can include, but not limited to, carbon fiber, bamboo, Curran, etc.

For the purposes as employed herein, the term "substrate" shall refer to a material, natural or synthetic, that is used as the base or body of the object. The substrate can be made from one or more than one material, such as thermoplastic acrylic-polyvinyl chloride or acrylonitrile butadiene styrene. Thermoplastics, or the equivalent, are advantageous as they are engineered for thermoforming fabrication, and combine properties of both the acrylic and the polyvinyl chloride components as manufactured by companies such as Sekisui SPI, Emco Plastics and Interstate Plastics. From acrylic, it obtains rigidity and formability; from PVC, toughness, chemical resistance and good interior finish ratings. Other materials, however, such as laminated wood, honeycombed materials, etc., can be used and are included herein under the term substrate.

For the purposes as employed there, the "crest" shall refer to the highest part of a wave.

For the purposes as employed herein the term "flex" shall mean to bend by expansion of one surface and contraction of the opposing surface.

For the purposes as employed herein, the term "gullet" shall mean the channel at the pommel, which provides clearance for the horse's withers so the saddle does not place pressure on the withers.

For the purposes as employed herein, the term "open aperture" shall refer to an opening of any configuration that is placed in the body of an object that is not subsequently filled with a slurry.

As used herein the term "overload" shall refer to a concentration of load forces that causes molecular deformation and a change in flex modulus.

For the purposes as employed herein, the term "points" shall mean the area of the pommel that extends from the gullet along the front portion of the saddle.

For the purposes as employed herein, the term "pommel" shall mean the front portion of the saddle consisting of a gullet and points.

For the purposes as employed herein the term "predetermined focused areas of flex" shall mean determining and then creating flexible areas within the substrate. The flexibility of these areas can be controlled as to the degree of flex and the direction of flex.

For the purposes as employed herein the term "epoxy" shall refer to any adhesive soft or hard, applicable to use with the chosen composite and substrate. These include various solid or semisolid amorphous fusible natural organic substances as well as any of a large class of synthetic products that have some of the physical properties of natural adhesives but are different chemically and are used chiefly in plastics.

For the purposes as employed herein, the term "soft epoxy" shall refer to any adhesive applicable for use with the chosen substrate that has an elasticity of about 150,000 PSI thereby being more flexible than standard epoxies while stiffer than adhesive sealants. The softer epoxy should have the ability to make structural bonds that can absorb the stress of expansion, contraction, shock and vibration. It is ideal for bonding dissimilar materials.

For the purposes as employed herein, the term "hard epoxy" shall refer to any adhesive applicable for use with the chosen substrate that has strong physical properties for structural bonding.

For the purposes as employed herein the term "saddle tree" shall mean the frame of a saddle onto which all additional materials are secured and forms the basic manner in which the saddle contacts the horse and rider.

For the purposes as employed herein, the term "scallop", "scallops" and "scalloped" shall mean the an edge marked with semicircles forming an undulation and having a length and a depth.

For the purposes as employed herein, the term "side bars" shall mean the portion of the saddle tree connecting the pommel and the cantle.

For the purposes as employed herein, the term "slurry" shall refer to a mixture of carton fiber, or its equivalent, and epoxy, soft or hard, that is used to create a stopple, adhere a stopple to an aperture, fill an aperture or any other use of the combination of materials.

For the purposes as employed herein, the terms "stopple" and "pins: shall be used interchangeably and shall refer to an epoxy/composite composition forming an object designed to fill a hole tightly.

For the purposes as employed there, the term "trough" shall refer to the lowest part of the wave between crests.

For the purposes as employed herein, the terms "wave" and "undulation" shall be interchangeable and refer to a regular rising and falling to alternating sides, forming crests and troughs.

Thermoplastic substrates provide advantages over wood and metals in many applications where weight, high strength, and shapeability are critical. There is no way, however, to create predetermined areas of flex within a rigid object without changing the thickness or creating apertures at critical areas. In order to overcome this problem and enable an object to flex a predetermined degree at a specific location and direction, aperture(s) are placed at the desired location. The placement of the apertures regulating the flex modulus allows flex, with the shape and size of the aperture determining the direction and degree of the flex. However, substrates, such as Kydex, lose their ability to return to form beyond a certain point of stretching and/or flexing at any non-contiguous surface, such as the edges or an aperture. The strength of the substrate lies in a continuation of the material and any aperture, or surface discontinuation, creates a weakness. It has been found that to create predetermined, focused areas of flex a slurry can be used to fill the apertures thereby eliminating the surface discontinuation. To further refine the degree and direction of the flex, stopples can be placed either in the cured slurry or into an aperture and adhered to the substrate using the slurry.

Flexibility is modulated by a number of factors and sub-factors beyond the substrate material. It will be obvious to those skilled in the art that the substrate material will affect the flexibility of the object and that, while still pertinent, the factors below will require adjustment based on substrate selection. The factors modulating flex are:

Aperture a. Placement of the aperture with respect to the required result, e.g. expansion, compression.
b. Diameter of the aperture
c. Depth of the aperture into the substrate
d. Shape of the aperture
e. Periphery of the aperture Slurry a. Composition of the slurry
b. Height of slurry above the surface of the object Stopple a. Diameter of stopple.
b. Distance of stopple above the object/slurry surface
c. Hardness of stopple materials
d. Combination of stopple materials
e. Stopple aperture
f. Distance of extension into slurry Apertures The Shape, depth, diameter, periphery and placement location of the apertures serve to create the predetermined areas of flex. The larger the diameter or periphery and greater the depth of the aperture, the greater the flex. The placement of any aperture will inherently create flax, the modulation of the flex within that area is determined by the foregoing factors.

Flex focuses the load forces in and around an unfilled aperture. A circular aperture will enable 360 degrees of flex while a non-circular aperture, such as an ellipse, or slot, will enable greater flex along the minor axis, with less along the major axis. The degree of flex is dependent upon the composition and dimensions of the substrate as well as the ratio of the aperture to the overall surface. When filled with slurry, the flex is modulated based upon the hardness of the slurry and the height in comparison with the substrate.

Apertures are generally created to retain the stopples that are adhered within the aperture with slurry. Apertures can also be filled with slurry without the addition of the stopples.

In one aperture embodiment, a primary aperture, having a diameter, or periphery, substantially greater than the diameter of the stopple, is formed to receive the slurry. A secondary aperture is then placed in the set slurry filling the primary aperture to receive the stopple. The primary aperture can be formed at the time the object is being formed or added subsequently.

In a second embodiment, the aperture has only a slightly larger depth and diameter than the stopple and slurry is used to adhere the stopple within the aperture.

A third embodiment creates the aperture, set slurry, and stopple as per above initial embodiment with a third, or tertiary aperture placed within the stopple.

Slurry

Slurry is used to fill the apertures as well as adhere the stopples within the apertures. The slurry is formed from a mix of chopped or shredded carbon fibers, or its equivalent, and epoxy to the consistence of a paste. For most applications, when set, the slurry will have a material hardness as the substrate, although this can be altered depending on the materials being used and the desired focus and degree of flex. As stated heretofore, when there is an interruption in the continuance of the substrate, such as at the apertures or edges, the exposed edges will eventually fail to return to form. Filling the apertures with the slurry solves the issue of the substrate stretching beyond its ability to return to its original form.

Slurry is used to create the stopples, fill in apertures, and as an adhesive to retain stopples.

The distance above the object surface that the slurry extends also affects the flexibility. The higher above the surface, the less flexibility and the lower, the greater the flexibility.

The hardness of the slurry dictates the amount of flex permitted. A softer epoxy, such as G/Flex, can be used to form a softer slurry. The softer slurry is generally used to form the stopples as used in the smaller apertures.

Stopple

A stopple that is retained by the slurry within an aperture having a slightly greater diameter will provide a different focused area of flex than a stopple that is placed in a large aperture filled with slurry that has been hardened. Additionally a very large aperture that has been filled with slurry allowed to harden with multiple small stopples subsequently placed, will have still another focused area of flex.

The stopples are formed from an epoxy carbon fiber mix and serve to provide a precisely controlled flexibility. The flexibility of the stopples is modulated by the hardness of the epoxy and the ratio between the composite and epoxy.

In addition to the height and diameter of the stopple, the smooth finishing of any exposed surface is critical to achieving a predetermined focused area of flex and prevent overload. Ridges, peaks and dimples in the exposed surface distort the flex modulus. Smooth finishing the exposed areas of the stopple enable the created energy to flow smoothly over the stopple, maintaining the intended flex modulus, while any damage to the stopple distorts the flow, changing the flex modulus.

To further increase the flexibility of the stopples, tertiary apertures can be drilled into the center of the stopple. The tertiary apertures must not have a diameter so close to that of the outer diameter of the stopple as to compromise structural integrity. The presence, or tack thereof, of a tertiary aperture will affect the direction and degree of the flex between one surface and the opposite surface.

The stopple, illustrated in FIG. 5, is a single composition stopple 430 from an epoxy composite mixture using a single epoxy. A stopple can also be divided, as in FIG. 6, forming a layered composition stopple 434, wherein one section is a mixture of composite and a first epoxy while one or more adjoining sections are composite and a second epoxy. In most instances, the layered composition stopple 434 will be a soft composition adjacent a harder composition and used in situations where the flex is directed to one surface while limiting flex on the opposing surface. For example, the use of a layered composition stopple 434, with a harder epoxy top layer 438 and softer epoxy bottom layer 136, centered in an arc would permit the ends of the arch to flex slightly while limiting flex that separates the two ends. The number of sections to a layered composition stopple as well as the respective hardness will be dependent upon the application and will be known to those skilled in the art in conjunction with the teachings herein.

The distance the stopples extend beyond the surface of the body of the object also affects flexibility. The extension can be at the top or bottom surface, or both, with the higher the extension, the less the flexibility. In most applications the stopples would extend about 0.5 in (12.7 mm) to about 0.030 in (0.762 mm) above the surface, however they can be as low as 0.005 in. (0.127 mm), depending on the application and the amount of flex required.

Figure 2:
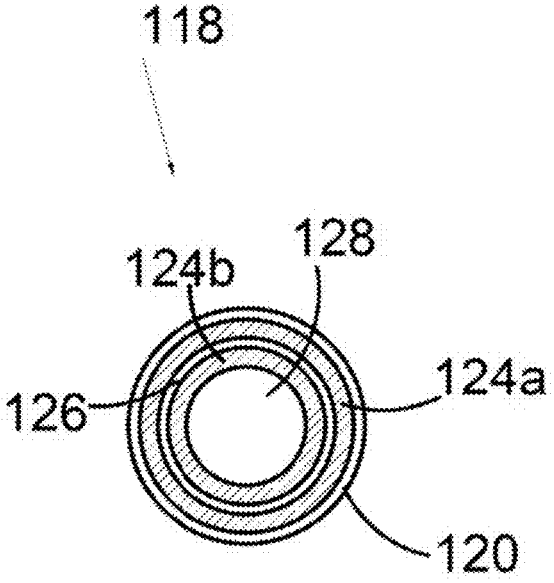
FIG. 2 is an enlarged top view of a small flex unit, in accordance with the disclosed invention.
Figure 3:
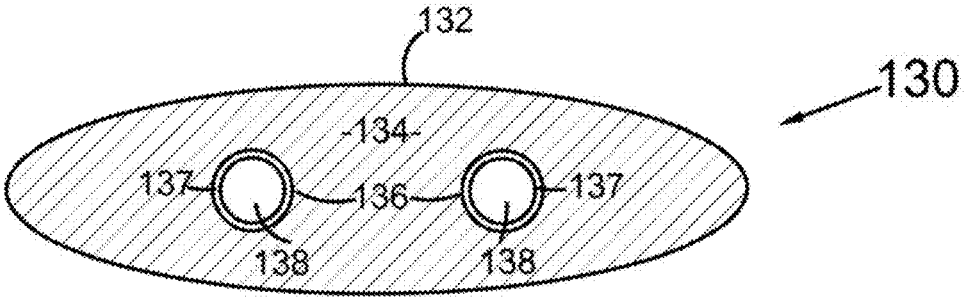
FIG. 3 is an enlarged top view of a multiple flex unit in accordance with the disclosed invention.

The stopples are generally cylindrical and an exact diameter would be dependent upon the end use. Further, layered composition stopples and single composition can be used in combination with any aperture and the selection is determined on the desired flex which will be known to those skilled in the art in combination with the teachings herein, Flex Unit As stated above, the predetermined focused areas of flex can be created through the use of a system of apertures, slurry and stopples, the combinations forming categories. An example of a large flex unit 100 is illustrated in FIG. 1, a small flex unit 118 in FIG. 2 and a multiple stopple unit 130 illustrated in FIG. 3. All of the flex units, large flex unit 100, small flex unit 118, and multiple stopple unit 130, are expanded and not necessarily in proportion to an actual flex unit 100, 118, or 130, however as tolerances are so small, detail would be lost in actual proportions. Additionally, throughout the illustrations relating to the disclosed system, flex units will not be illustrated with all the elements as illustrated in FIGS. 1, 2 and 3 due to size but will be referred to by flex unit number. Further, although the large flex unit 100 is illustrated with an interior aperture 110 and the small flex unit 118 and multiple flex unit 130 without the interior aperture, the interior aperture can be eliminated or added to either.

The large flex unit 100 consists of an outer, primary aperture 102 that is drilled, or otherwise created, into the object. The primary aperture 102 can extend completely though from the top surface to the bottom surface or only part way through from either top or bottom surface of the substrate. The primary aperture 102 is filled with a slurry 104*a* that is permitted to harden. Within the hardened slurry 104*a* a secondary aperture 106 is created that is dimensioned to receive the stopple 108. To adhere the stopple 108 a thin layer of slurry 104*b* is used. It should be noted that in the illustration of FIG. 1 there is a space between the various elements, however in actual practice this space will be minimal. Within the stopple 108 is the tertiary aperture 110 that remains unfilled and serves to provide additional flex to the unit. The spacing is again for ease of illustration and clarity in defining the elements, in actual use, the interior diameter of the secondary aperture 106 and the outer diameter of the stopple 108 would be within 0.001 in. (0.0254 mm). The outer diameter of the tertiary aperture 110 must not be so great as to compromise the structural integrity of the stopple 108, however to some degree the amount of flex can be controlled via the outer diameter.

The small flex unit 118 consists of s primary aperture 120 that is drilled, or otherwise created, into the object. The primary aperture 120 can extend completely though from the top surface to the bottom surface or only part way through from either top or bottom surface. The primary aperture 120 is filled with a slurry 124*a* that is then permitted to harden. Within the hardened slurry 124 a secondary aperture 126 is created that is dimensioned to receive the stopple 128. To maintain the stopple 128 within the secondary aperture 125, slurry 124*b* is used. It should be noted that as with in the illustration of FIG. 1, FIG. 2 also illustrates a space between the elements. The space in for ease of illustration and clarity in defining the elements.

In FIG. 3 the multiple stopple unit 130 is illustrated as an oval surrounding aperture 132, however any configuration holding more than one stopple can be used, depending upon flex criteria. The surrounding aperture 132 is filled with slurry 134 into which apertures 136 are placed. The apertures 138 are filled with slurry 137 and the stopple 138 placed within the secondary aperture 136.

Figure 4:
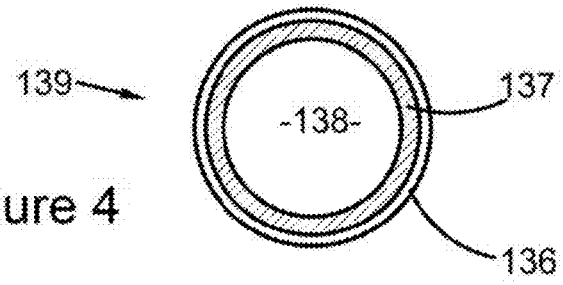
FIG. 4 is an enlarged top view of a single flex unit in accordance with the disclosed invention.

In FIG. 4 the single flex unit 139, consisting of aperture 136, slurry 137 and stopple 138, is illustrated, in greater detail. The single flex unit 139 construction can be used alone or within a surrounding aperture as well as in combination with other flex units.

EXAMPLE

The foregoing technology can be used any object requiring the modulation of flex. The determination of the placement and control of the flex, as set forth above, would depend on the object of use. For example, 8 skateboard would require different: placement and type of flex units than water skis.

Saddle Tree

The English saddle tree has kept approximately the same shape and has been made primarily of wood for hundreds of years until after WWII. At that time sprint steel attachments were incorporated into the design to allow the tree to improve flexibility without negatively impacting structural integrity. Until the recent use of plastics, and other manmade materials, little had been done to modify construction. To prevent discomfort to the horse, a saddle must provide some flexibility; however excessive torque and force management have been a problem with prior art trees of wood construction.

The latest major advancement in saddle trees was disclosed in U.S. Pat. No. 6,044,630, in which a saddle having improved balance and fit of a saddle is disclosed and U.S. Pat. No. 7,231,889 in which a saddle further improving the comfort and contact between a rider and horse: Further improvement to the flexibility has been achieved through the addition of varied thickness as disclosed in U.S. Pat. No. 9,586,809. The disclosures of the '630, '889 and '809 patents being incorporated herein as though recited in full.

Until the recent use of plastics, and other manmade materials, little had been done to reduce weight of saddle trees. The latest major advancement in saddles trees was disclosed in U.S. Pat. No. 6,044,630, in which a saddle having improved balance and fit of a saddle is disclosed and U.S. Pat. No. 7,231,889 in which a saddle further improving the comfort and contact between a rider and horse. Further improvement: to the flexibility has been achieved through the addition of varied thickness as disclosed in U.S. Pat. No. 9,586,809. The disclosures of the '630, '889 and '809 patents being incorporated herein as though recited in fait. The '809 will be referred to regarding construction of the saddle tree that is fully set forth and only the novel areas will be discussed in detail herein.

The following example of a saddle tree is used to illustrate how the predetermined focused areas of flex are created in a saddle tree providing a precise flex modulation. This is a complex placement of apertures, slurry densities and stopple combinations and serves as an illustration of the technology.

As noted heretofore, flexibility is modulated by aperture placement and diameter; slurry composition and curvature above the object surface; and stopple diameter, composition and distance above the object/slurry surface. The following is applicable to the described example 16-17 inch saddle tree and dimensioning for larger and smaller trees will be obvious to those skilled in the art Aperture a. Placement of the apertures. The apertures on a saddle are placed to allow a tree to flex in response to load forces while maintaining a relatively consistent contact with the horse. To do so, the tree must flex with the movement of the horse. The apertures are place to enable the necessary flex while prevent over flex at critical areas such as the pommel.
b. Diameter of the apertures. The diameter of the apertures in the disclosed saddle tree vary depending on placement on the saddle. The diameter of the apertures is dependent upon the predetermined focused degree of flex.
c. Depth of the apertures. The apertures in the disclosed saddle tree will extend completely through the substrate or partially through from the underside up.

Slurry a. Composition of the slurry. The hard slurry used with the saddle tree 10 is a 1 to 1 mixture of hard epoxy to soft epoxy and cat composite that produces the hardness similar to that of the substrate. The soft slurry is a mixture of soft epoxy and cut composite that is used in stopples to permits a predetermined degree of flex.
b. Height of slurry above the surface. Flex modulation is achieved by controlling the height of the slurry above surface of the object in the disclosed saddle tree the slurry is between 0.015 and 0.030 in above the surface, depending upon the placement of the aperture.

Stopple a. Diameter of stopple. Two stopple sizes are used in the saddle tree with the large stopple being in the range of 0.109 in. (2.76 mm) to 0243 in (6.18 mm) and preferable 0.203 in (5.18 mm). The small stopple is within the range of 0.060 in (1.54 mm) to 0.143 in (3.64 mm) and preferably 0.103 in (2.64 mm).
b. The distance of the stopples above the surface of the slurry is about 0.005 in (0.127 mm) to about 0.100 in (2.54 mm). Each stopple has a width and height above the surface that allows flex and creates protection of the substrate. The lower the stopple with respect to the surface, the more the flex and the precise flex modulating can be achieved through height, size and material of the stopple.
c. Hardness of stopple materials. The disclosed saddle tree uses two hardnesses of stopples. The first being referred to as a hard stopple which is a substrate and epoxy mix in to produce similar hardness as the surrounding material.

The second uses a more flexible epoxy, such as G/Flex mixed with the cut composite. The flexible epoxy is generally used in either a layered composition stopple or in the smaller stopples as the hard epoxy will not provide the required flex in the small apertures. Alternatively a combination of hard and soft epoxy can be used with the ratios depending upon the required flexibility.

d. Combination of stopple materials. In sore areas, such as the pommel, the layered composition stopple 434 is advantageous.

e. Distance of extension into slurry. Depending upon the location, the stopples in the saddle tree extend completely through the slurry, from one surface of the substrate to the opposing surface, or part way into the slurry.

Flex Unit

Unless noted to the contrary, the stopples within the flex units do not extend from the underside of the tree to the top side of the tree. The extension is general in the range of about 1/16 to about 1/8 of an inch. The flex units are constructed on the underside of the tree and therefore any extensions of the stopple or slurry are from the underside unless otherwise noted.

Figure 8:
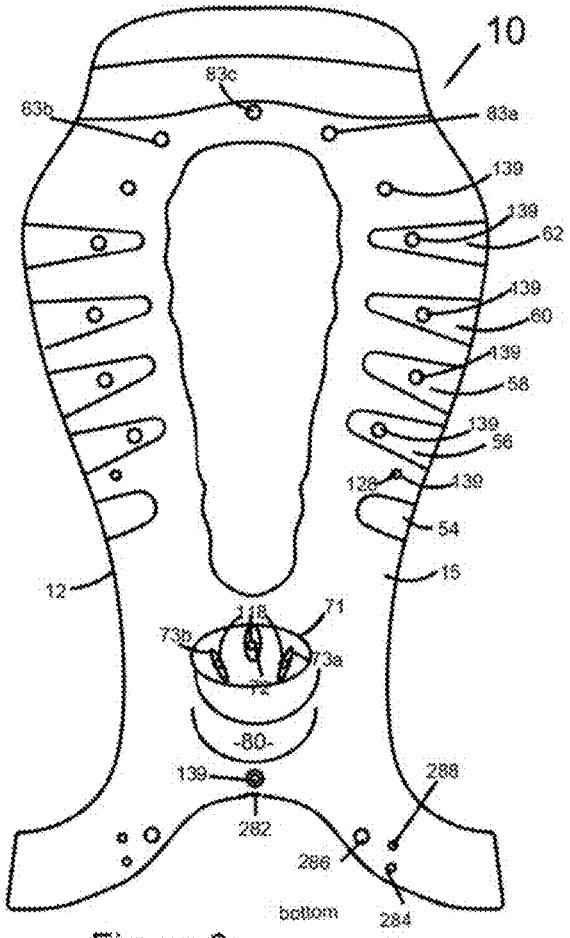
FIG. 8 is a bottom view of the saddle tree prior to the addition of carbon fiber; in accordance with the disclosed invention.

FIG. 5 illustrates the topside of the saddle tree 10 and FIG. 8 the underside, both of which are described in conjunction with one another. These figures are shown prior to the addition of the composite used for reinforcement to clearly illustrate the novel features and their placement on the tree. As both edges of the saddle tree are mirror images, only one edge of each the top and bottom will be described. The saddle tree is manufactured according to patents referenced herein. For reference the saddle tree 10 will be divided into cantle, side bars, and pommel. As with standard saddle trees, the interior of the saddle contains a channel 18 to clear the horses spine.

Cantle

Figure 7:
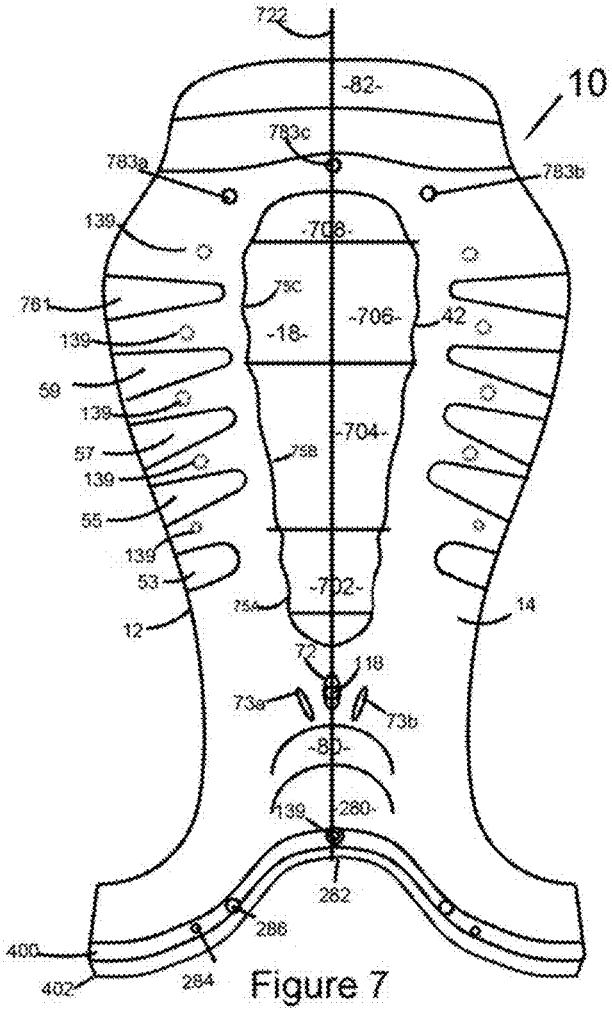
FIG. 7 is a top view of the saddle tree prior to the addition of cart n fiber; in accordance with the disclosed invention.

The cantle 782, illustrated in FIGS. 7 and 8, of a properly fitting saddle receives far less stress than the seat or pommel of the saddle 80. Although flex is needed it is not necessary to control the flex as finely as with the seat and pommel. As illustrated apertures 783*a* and 783*b* are drilled or molded into the tree 10 either partially or completely through and filled with slurry. A single aperture 83*c* is placed on the centerline 22 and remains unfilled.

Side Bars

The side bars, extending between the cantle 82 and the pommel 80, shown in FIGS. 7 (topside of tree) and 8 (underside of tree), have an open channel 18 to accommodate the horse's spine within the center of the saddle tree. The majority of the interior edge 42 of the channel 18 is slightly scalloped, a configuration that is created by cutting into the interior edge 42 to a depth of approximately 0.03 in (0.762 mm). The scallops can be as much as 0.06 in. (1.524 mm) or as lithe as 0.01 in. (0.254 mm), however closer to 0.03 in (0.0762 mm) of an inch provides optimum results. To clearly describe the dimensioning of the scallops, FIG. 7 has the channel 18 divided into four sections, 702, 704, 706 and 708. The scallops 75A start beyond the curve of the channel 18 at the pommel 80, within channel section 102, and extend to channel section 104 with only sufficient space to accommodate one or two scallops. Within channel section 104, there is a single scallop 75B that extends approximately 1/3 the length or 20-40% of the total length of the channel 18. With channel section 106, which extends almost to the end of the channel 18, there are about three to four scallops 75C. Channels, section 108 is void of scallops and consists of the curve of the channel 18 proximate the cantle 82. The scallops 75A within channel section 702 have a scallop length of about 0.93 in. (2.286 mm) to about 0.97 in, (24.638 mm). In Section 704 length of the scallop 75B is longer and flatter, about 2.75 in. (09.85 mm) to about 3 in. (76.2 mm). In Section 706, the scallops 75C return the approximate size as place in Section 102. The scallops enable a lateral stretch and contraction to follow the movement of the horses back.

As illustrated wave depressions 54, 56, 58, 60 and 62 are molded into the underside 15 of the saddle tree 10, and wave depressions 53, 55, 57, 59, and 61, which are off set from depressions 54, 56, 58, 60 and 62, are molded into the topside 14. This combination forms an undulation along the edge 12 and a portion of the side bars. Waves 54 and 53 have a half oval configuration while waves 56-62, and their counterparts 55-61 are cone shaped. The waves are about 0.03 in. (0.762 mm) deep and spaced along the edge of each side 12 of the tree 10. The waves and the resulting undulations are fully disclosed in the '086 application which can be referred to for additional information, including the critical placement and dimensioning of the waves.

Wave depressions create undulations along the outside perimeter of the tree provide a means to increase comfort for both horse and rider. The wave depressions enable the saddle to lengthen and compress as the horse's hack moves with each step. The placement, depth and length of the wave depressions are ail critical to maintain a balance between strength and flexibility.

In the '086 application, long slots were used on the side bars, intersecting waves 57-62. It has been found that, although the long slots provided the necessary flexibility, they also provide too great a focus at the top and bottom edges, thereby weakening the substrate. Additionally, finer control of predetermined focused areas of flex can be achieved through the use of apertures, slurry and stopples.

In the disclosed embodiment single stuffy flex units 139 are placed, five on each side and evenly spaced, toward the crest of the waves 55, 57, 59, and 61 (shown in phantom). The stopples 138 extend up from the underside 15, extending into the slurry 137 about 0.125 in. (3.175 mm) to about 0.25 in. (6.35 mm). In this embodiment, the slurry 137 is used as an adhesive to retain the stopples 138 within the substrate. Placement of the single slurry flex units 139 enables each wave to not only lengthen along the sides 12 but to flex within the wave. In the illustrated embodiment, five (5) single slurry flex units 139 are illustrated per side, however this number can vary depending on saddle size.

The single slurry flex unit 139 placed between the waves 55 and 56 and the pommel 80 uses a softer epoxy stopple 128. The required flex in this portion of the saddle tree 10 is less than toward the cantle 82 and therefore a softer stopple 128 can be used.

The placement of the waves with respect to the center line 22 is critical. The back waves 61 and 62 are +/−90 degrees to center to allow the back of the saddle greater flexibility toward the cantle. To prevent over flexing, the wave depressions stop at the point where the cantle starts to curve upward as can be seen easily in FIG. 7, although in some styles, such as Western, the depressions can extend further. On most saddles however, extending the waves beyond the point where the cantle starts to curve will compromise the strength of the saddle, Pommel Between the channel 18 and the pommel 80, on the underside of the tree 10, is the pommel wave 71. As physics requires that a wave needs an edge to flex, the wave 71 has an ellipse 72 and slots 73*a* and 73*b*, to provide the necessary edge. The pommel wave 71 enables the torque created by movement of the horse to "move through" the saddle in a controlled manner without resistance or obstruction.

Within the ellipse 72, which spans the centerline of the saddle tree, a small flex unit 118 is placed at the center. The small flex unit 116 in this location is a two layered composition stopple 434 having a hard epoxy top portion 438 and a soft epoxy bottom portion 436. This combination serves as keystone and makes expansion at bottom possible while preventing expansion at the top, preventing the top surface 14 from crushing and Allowing the underside 15 to flex. The slurry 124*a* and 124*b* match the curvature of the underside of the tree 14 with the stopple 434 extending about 0.005 in (0.127 mm) to about 0.020 in (0.208 mm) above the slurry 124*b* surface. Due to the critical placement of this, and the single flex unit 139 at the pommel edge 282, the stopple 128 within the small flex unit 118, extends to the surface.

On either side of the ellipse 72, slots 73*a* and 73*b* are placed at an angle 24 to 26 degrees from the centerline 22, although their placement can vary up to 40%, to enable the pommel to flex up and out from the horse's withers. Greater than a 35 degree angle starts to negate the value of the slots 73*a* and 73*b* and reduce optimal control. The slots 73*a* and 73*b* are 0.0625 in (1.587 mm) wide and 0.375 n. (9.525 mm) long, although these dimensions can vary slightly. The slots 73*a* and 73*b* extend from the underside to the top surface of the tree 10 and are filled with slurry that extends above the surface 15 approximately 0.005 in (0.127 mm) to about 1.020 in (0.508 mm), preferably 0.01 in and is permitted to hardened. The small flex units 118 are drilled from the underside 15 of the tree 10 part only partially into the composite, approximately 0.0625 in (1.587 mm) to 0.125 in (3.165 mm). The small flex units 118 within slots 73*a* and 73*b* do not extend through to the top surface 14, thereby further controlling the amount of flex in the pommel 80 area.

The proximal section of the pommel 280 has a single flex unit 139 at the apex 262 of the pommel 80 curve that also extends through from the underside 15 to the top 14. The stopple 434 within the single flex unit 139 is layered with the hard epoxy 438 at the top and soft epoxy 436 at the bottom. This, like the malt flex unit 118 within the ellipse 72, lets the pommel 80 flex with the horse's movement without over flexing. This single flex unit 139, in combination with the small flex unit 118 in ellipse 72, serve as a keystone to the flex process. The use of the layered stopple 434 is critical in that the hard top layer 438 which is in compression and presses on the harder composite of the stopple.

The majority of saddles have a saddle, or pommel, nail 350 (FIG. 9) having an expanded button head 352 on the end of the shaft 354. The saddle nail 350 passes through aperture 284, seen in more detail in FIG. 10, however when assembled without the addition of slurry, creates a hole in the frame that serves as a flex point. To protect the substrate wall and eliminate an unwanted a flex point, slurry is placed above the surface within the double layer of carbon fiber (described hereinafter). The aperture 284 is slightly larger than nail shaft 354 and the use of the slurry serves to both protect the substrate wall and secure the nail shaft 354 within the aperture 284.

A large flex unit 100 is placed within the aperture location 286 with a tertiary aperture dimensioned to fit the diameter of the nail shaft 354. The stopple 108 is a hard epoxy/composite mix. Like the aperture 284, the aperture location 286 is within the carbon fiber overlap Once placed within aperture 284, the end of the nail shaft 354 is bent in two locations, one to permit the shaft 354 to span the distance between the aperture 284 and aperture 286 and the other so that the tip of the shaft 354 is inserted into tertiary aperture 110 within the large flex unit 100. Bending the shaft 354 away from the aperture 284 will place the shaft 254 in a position to interfere with the remaining hardware of the saddle.

A single flex unit 139 is placed at location 288, centered between the aperture location 186 and the aperture 284 and spaced away from the proximal edge of the pommel. The placement is beyond the double layer of carbon fiber, which opens the direction of the flex away from the horse's shoulder. The stopple 128 is a hard epoxy/composite mix having a similar hardness to the substrate.

The spacing of any of the flex units from the pommel apex 282 wilt directly affect the flex. The further from the pommel apex 282, or any other arch, the less impact on the flex of the tree.

Figure 9:
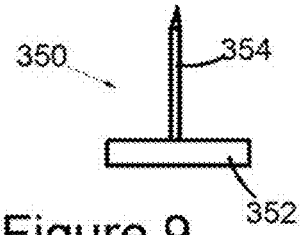
FIG. 9 is a side view of the saddle nail, in accordance with the disclosed invention.
Figure 10:
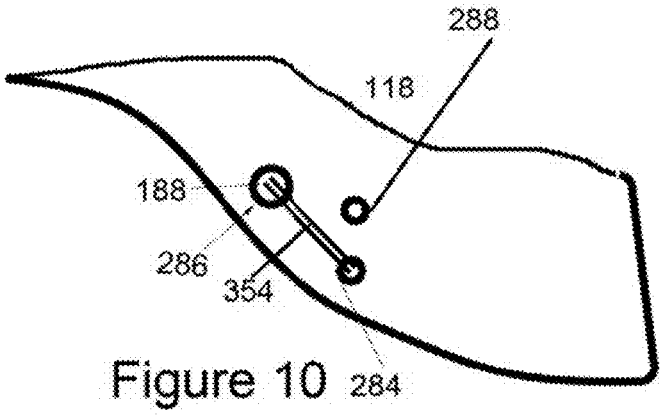
FIG. 10 is a fragmentary view of the saddle nail within the saddle tree, in accordance with the disclosed invention; and, FIG. 11 is a side view of the leather flaps of a saddle showing the placement of the saddle nail, in accordance with the disclosed invention.
Figure 11:
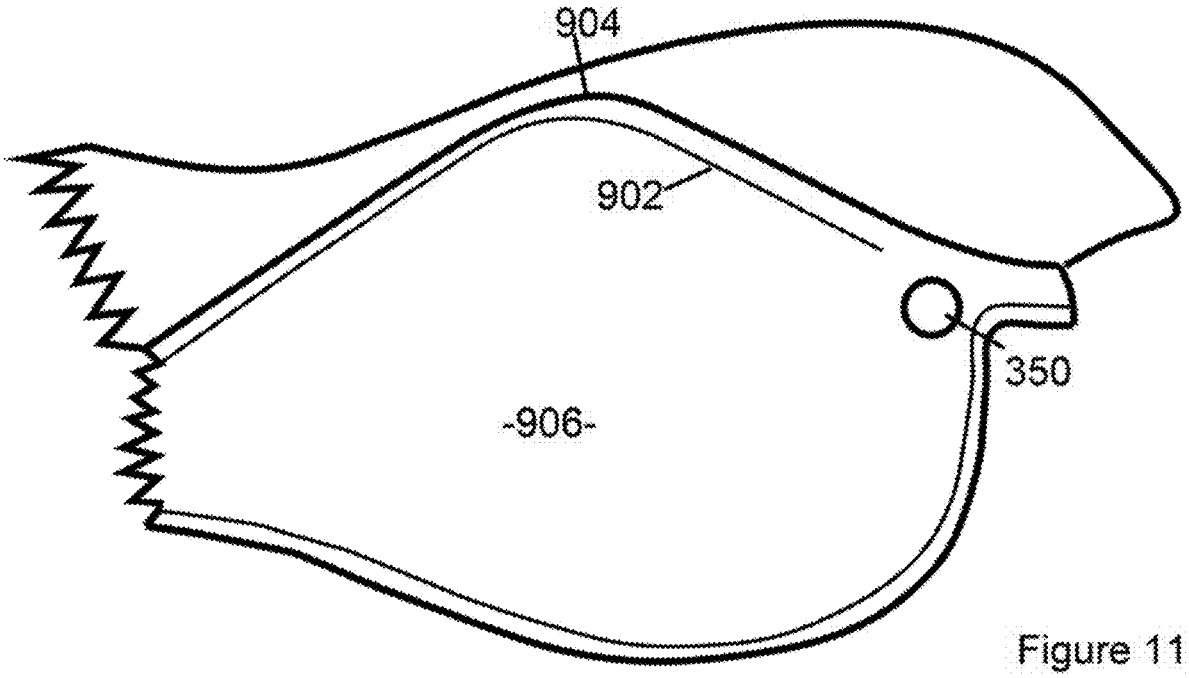
Figure 13:
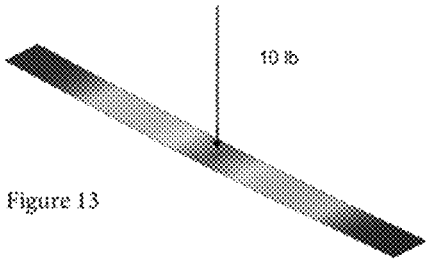
FIG. 13 is a graph illustrating the stress field of a carbon specimen with apertures and without stopples.
Figure 14:
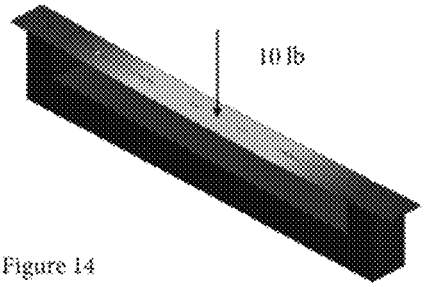
FIG. 14 is a graph is a graph illustrating the stress field of a carbon specimen without apertures or stopples.
Figure 15:
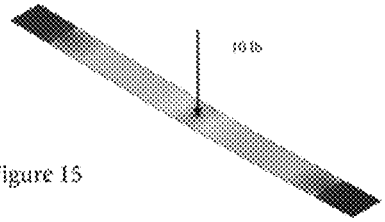
FIG. 15 is a graph illustrating the stress field of a carbon specimen with both apertures and stopples; and, FIG. 16 is a graph illustrating the stress field of a carbon specimen with both apertures and stopples.
Figure 16:
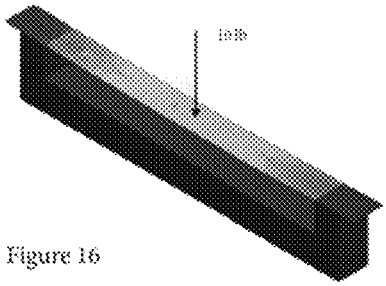

As seen in FIG. 9, the placement of the nail 350 is at the beginning point of the leather stitching 902 and arch 904 of the leather panel 908. With a user seated at the center of the arch, the pressure is spread like a bow. The arch of the 904 of the leather panel 906 and stitching 902 interacts with the channel 18 scallops, causing the saddle side bars to flex in response to the horse's movement.

Carbon Fiber Fabric

Carbon fiber sheets and strips are added to the underside 15 of the tree as taught in the '086 and, as illustrated in FIG. 12, the carbon fiber 400 is wrapped up the edge 402 of the tree, overlapping the top 14 by about 0.375 in (9.525 mm). The carbon fiber 404 on the top 14 of the saddle tree 10 wraps over the edge but does not extend to the underside 15 of the tree 10. Along the points and bars of the tree, the overlap of the carbon fiber 404 extends to approximately the first wave 55. This, however, will vary depending upon the size and type of the saddle. The greater portion of the saddle tree 10 edges that are covered with the wrapped carbon fiber 404, the less the flexibility.

As seen in FIG. 7, the apertures 284, 286 and the small flex unit 118 at the pommel apex 282 all fall within the double layer of carbon fiber. This design provides a double layer of carbon fiber along the proximal pommel 282 and therefore more rigidity and support. The more the carbon fiber extends up and over the top 14, the more rigidity and the 0.375 in (9.525 mm) overlap can, in some instances, need to be modified.

Test Data

A test setup and load testing of the various specimens was initially set up. To test, a specimen was supported at two points by blocks 18.5" apart, with the specimen centered between them. Precision calipers were used to measure the unloaded height from a fixed datum at the center of the specimen. Then, weight was hung from the marked center of the specimen of the strap, and the height at the center was again measured. The difference is the deflection of the specimen. This difference was compared to the displacement of the computer model. Changes to the model mesh size, material parameters, and other details of its construction were made to try to match the modeled deflection with the test results. Below is a brief comparison of the current values:

| Test case 10 lb load | Measured Result | Analysis Result | % Difference |
|---|---|---|---|
| Specimen no carbon or pins | 0.402" | 0.435" | −8% |
| Specimen w/carbon & pins | 0.196" | 0.164" | 16% |
| Specimen w/carbon & pins | 0.188" | 0.139" | 26% |

Additional information produced from initial testing includes the stress and strain plots in FIGS. 13-16. Stress is a measure of loading per unit area, while strain is a measure of the deformation of a part due to stress. The shape of the stress and strain fields is an interesting way to view the mechanical effects of adding the pin features to the body. It is shown that without the pins, the fields are fairly even across the length of the specimen. With the pins, areas of low stress around the pin location are illustrated despite larger stresses in the broader region. Similarly, there is a low area of strain on the side of the pins opposite from the applied load. This indicates that the pin features can be used to create and shape high stress areas throughout the boundaries of a material. Although just having holes can cause a similar effect, as stated heretofore, "stress concentrations" or high stresses form around holes will, in most applications, cause materials to fail.

Broad Scope of the Invention

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims (e.g., including that to be later added) are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language of the present invention or inventions should not be improperly interpreted as an identification of critically, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure, the following abbreviated terminology may be employed: "e.g." which means "for example."

What is claimed is:

1. An equine saddle tree with predetermined focused areas of flex comprising:

a body, said body being rigid and formed from a moldable substrate and having:

a. a top surface, b. an underside, c. a cantle, d. a pommel, e. a center channel, and f. sidebars; and multiple flex units within said body, each of said multiple flex units comprising at least one aperture, each of said at least one aperture extending from said underside toward said top surface and having:

a. a predetermined configuration comprising a shape, a periphery, a diameter, and a depth;

b. a predetermined placement within said saddle tree; and c. at least one fill material filling in each of said at least one aperture, said at least one fill material is at least one stopple, each of said at least one stopple having a predetermined hardness, a diameter, and a length, and wherein a combination of said hardness, said diameter, and said length affects flexibility of said multiple flex units, said at least one fill material hardening within each of said at least one aperture;

wherein a first of said at least one fill material is a hard stopple comprising a hard epoxy and carbon fiber mixture;

wherein a second of said at least one fill material is a soft stopple comprising a soft epoxy and carbon fiber mixture;

wherein a third of said at least one fill material is a stopple comprising a slurry comprised of a mixture of hard epoxy, soft epoxy, and carbon fiber; and wherein a fourth of said at least one fill material is a combination stopple having a first portion and second portion of said length, said first portion being a hard stopple comprising a mixture of substrate and epoxy and said second portion being a flexible stopple comprising a mixture of composite and flexible epoxy; and wherein said multiple flex units form flex unit categories, said categories being determined by a combination of said at least one aperture, said predetermined placement, and selection of said at least one fill material to fill in each of said at least one aperture; and wherein placement of each of said multiple flex units determines a degree and direction of flex of each of said areas of flex of said saddle tree.

2. The saddle tree of claim 1 wherein a first of said multiple flex unit categories is defined as having said at least one aperture filled with said slurry.

3. The saddle tree of claim 2 wherein said slurry filling said first of said at least one aperture of said first of said categories is permitted to harden and a second of said at least one aperture in said slurry that has hardened, said second of said at least one aperture having a diameter greater than said diameter of one of said at least one stopple, said one of said at least one stopple being secured within said second of said at least one aperture by addition of said slurry.

4. The saddle tree of claim 1 wherein a second of said multiple flex unit categories is defined as having said at least one aperture having a diameter greater than said diameter of said at least one stopple, said at least one stopple being secured within said at least one aperture by said slurry.

5. The saddle tree of claim 1 wherein a third of said categories is defined as one of said at least one stopple secured within a first of said at least one aperture and further comprising a second of said at least one aperture within said one of said at least one stopple.

6. The saddle tree of claim 1 wherein a fourth of said categories is defined as said at least one aperture filled with said third of said fill materials.

7. The saddle tree of claim 1 wherein said diameter of a first size of said at least one stopple is in a range of 0.109 in. (2.76 mm) to 0.243 in (6.18 mm).

8. The saddle tree of claim 1 wherein said diameter of a second size of said at least one stopple is in the range of 0.060 in (1.54 mm) to 0.143 in (3.64 mm).

9. The saddle tree of claim 1 wherein said hardness of said at least one stopple is a hard stopple comprising a mixture of substrate and epoxy and having a hardness equal to said substrate.

10. The saddle tree of claim 1 wherein said hardness of said at least one stopple is a flexible stopple comprising a mixture of composite and flexible epoxy.

11. The saddle tree of claim 1 wherein said at least one aperture is on the underside of said saddle tree, and a level of fill of said at least one fill material for each of said flex units is selected from the group consisting of: lower than a plane of a surface of said underside; on a same plane as said surface of said underside; and above said surface of said plane of said underside, said level of fill affecting flexibility.

12. The saddle tree of claim 1 wherein said shape of said at least one aperture is a circle that enables 360 degrees of flex.

13. The saddle tree of claim 1 wherein said shape of said at least one aperture is non-circular, said shape enabling greater flex along a minor axis, with less flex along a major axis.

14. The saddle tree of claim 11 wherein said at least one stopple extends 0.005 in. (0.127 mm) to about 0.5 in (12.7 mm) above said surface of said underside.

15. The saddle tree of claim 1 wherein said diameter of a first size of said at least one stopple is 0.203 in (5.18 mm).

16. The saddle tree of claim 1 wherein said diameter of a second size of said at least one stopple is 0.103 in (2.64 mm).

17. An equine saddle tree with predetermined focused areas of flex comprising:

a body, said body being a moldable, rigid substrate and having:
- a top surface,
- an underside, said underside having a surface,
- a cantle,
- a pommel,
- a center channel, and
- sidebars;

multiple flex units within said body, each of said multiple flex units comprising at comprising at least one aperture, each of said at least one aperture extending from said underside toward said top surface and having:
- a predetermined configuration comprising a shape, a periphery, a diameter, and a depth; and
- a predetermined placement within said saddle tree; and
- at least one fill material filling in each of said at least one aperture, said at least one fill material hardening with each of said at least one aperture, each of said at least one fill material being selected from the group comprising: a hard epoxy and carbon fiber mixture; a soft epoxy and carbon fiber mixture; and a slurry comprised of a mixture of hard epoxy, soft epoxy, and carbon fiber;

each of said flex units having a level of fill of said at least one fill material, said level of fill being selected from the group consisting of: lower than a plane of a of said surface of said underside; on a same plane as said surface of said underside; and above said surface of said plane of said underside, said level of fill affecting flexibility of said saddle tree;

each of said multiple flex units form flex unit categories, said categories being determined by a combination of said at least one aperture, said predetermined placement, and selection of said at least one fill material to fill in each of said at least one aperture;

wherein said at least one fill material is at least one stopple, each of said at least one stopple having a predetermined hardness, a diameter selected from the group comprising: a first diameter in a range of 0.109 in. (2.76 mm) to 0.243 in (6.18 mm); a second diameter in the range of 0.060 in (1.54 mm) to 0.143 in (3.64 mm) and a length, selected from the group comprising lower than a planed of said underside, on the same plane as said underside or above said underside 0.005 in. (0.127 mm) to about 0.5 in (12.7 mm); a combination of said hardness, said diameter, and said length affects flexibility of said multiple flex units;

wherein a first of said multiple flex unit categories is defined as having said at least one aperture filled with said slurry; said slurry filling said first of said at least one aperture being permitted to harden and a second of said at least one aperture being created in said slurry that has hardened in said first of said at least one aperture, said second of said at least one aperture having a diameter greater than said diameter of said at least one stopple, said at least one stopple being secured within said second of said at least one aperture by additional said slurry;

wherein a second of said multiple flex unit categories is defined as having said at least one aperture having a diameter greater than said diameter of said at least one stopple, said at least one stopple being secured within said at least one aperture by said slurry;

wherein a third of said categories is defined as one of said at least one stopple secured within a first of said at least one aperture and further comprising a second of said at least one aperture within said one of said at least one stopple; and wherein a fourth of said categories is defined as said at least one aperture filled with said third of said fill materials; and wherein placement of each of said multiple flex units determines a degree and direction of flex of each of said areas of flex of said saddle tree.

* * * * *